United States Patent [19]

Te

[11] 4,078,803

[45] Mar. 14, 1978

[54] BOARD GAME WITH ANIMAL TOKENS

[76] Inventor: Henry Te, 1331 N. Maple St., Burbank, Calif. 91505

[21] Appl. No.: 594,686

[22] Filed: Jul. 10, 1975

[51] Int. Cl.[2] ..... A63F 3/00

[52] U.S. Cl. ..... 273/248 GA; 273/302

[58] Field of Search ..... 273/131, 134

[56] References Cited

U.S. PATENT DOCUMENTS

| | | | |
|---|---|---|---|
| 866,447 | 9/1907 | Falkenberg | 273/134 AC |
| 952,997 | 3/1910 | Sanderson | 273/134 AC |
| 3,870,311 | 3/1975 | Klupp | 273/131 AB |
| 3,908,998 | 9/1975 | Fong | 273/131 AB |

FOREIGN PATENT DOCUMENTS

| | | | |
|---|---|---|---|
| 63,187 | 3/1955 | France | 273/131 K |
| 903,699 | 1/1945 | France | 273/134 AC |
| 418,934 | 2/1967 | Switzerland | 273/134 AC |
| 599,206 | 3/1948 | United Kingdom | 273/134 AC |
| 609,218 | 9/1948 | United Kingdom | 273/134 AC |
| 525,521 | 8/1940 | United Kingdom | 273/134 AC |

*Primary Examiner*—Richard C. Pinkham
*Assistant Examiner*—Harry G. Strappello

[57] ABSTRACT

An educational board game featuring the map of the world on which various means of transportation, along with routes, cities, air stations and harbors are scattered, a plurality of native homes of animals of the world which are placed according to real life on the various routes in different parts of the world map. Each player is given a plurality of animal tokens which he sends to their native homes via different routes and methods according to the rules of playing the game. The winner is the player that gets all his given animals (tokens) to their native homes first.

3 Claims, 49 Drawing Figures

FIG. 3-9

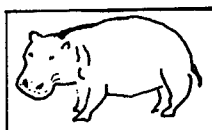

4

HIPPOPOTAMUS

Live along the rivers of tropical Africa. They are excellent swimmers and floaters and can even walk along the river bottom. A bull usually weighs 3,500 to 5,000 lbs.

FIG. 3-10

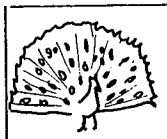

13

PEACOCK

Native to India and Ceylon. Females are Peahens. Peacock can spread its handsome tail to 7 ft long.

FIG. 3-11

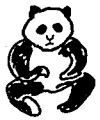

11

GIANT PANDA

These bear family animals live in the dense bamboo jungle in the high level in Tibet and China. Adults may weigh 200 to 380 lbs. They are shown in zoos in china and elsewhere presently only in Moscow, London and Wash. DC.

FIG. 3-12

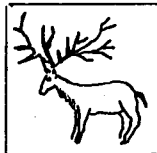

5

REINDEER

Are kinds of Caribou domesticated in northern Europe and Siberia. They pull sleds and provide milk, meat and skin for clothing but they do poorly in most zoos.

FIG. 3-13

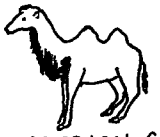

10

BACTRIAN CAMEL is two humped. They are domesticated although some are still wild in the Gobi Desert. They are great beasts of burden

FIG. 3-14

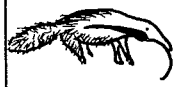

2

GIANT ANTEATERS

Are jungle dwellers of Central and South America. They use the long clows on their powerful front legs to tear open termite nest. Then a nearly foot long tongue flicks up the insects.

FIG. 3-15

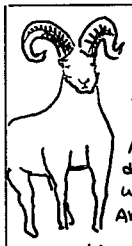

7

BIGHORNS

Are mountain-dwelling sheep western North America. They travel in bands, but the rams (males) frequently keep apart. A few zoos have been successful in keeping and rearing Bighorns.

FIG. 3-16

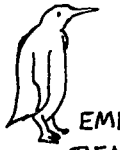

16

EMPEROR PENGUINS

Largest of the penguins, stand 4 ft. tall. Spend most of their life at sea off Antarctica, coming ashore only to reproduce. A good swimmer, Penguin can travel as fast as 25 m.p.h. on water.

FIG. 4-1 3

Move your African animals 7 steps or less

FIG. 4-2 3

Take express train to the nearest Harbour or if any of your animals lands on a slede route either in Arctic Circle or in Ant-Arctic Circle, you may slide that animal all the way to the end of that route

FIG. 4-3 3

Take Express train to the nearest Air Station or if any of your animals lands on a slede route either in Arctic circle or in Antarctic circle, you may slide that animal all the way to the end of that slede route

FIG. 4-4 3

Your animals are Chased by Zoo Keeper, take extra turn to escape

FIG. 4-5 3

Your Australian animal is wounded by hunter. Go back 3 steps to see the Veternarian.

FIG. 4-6 2

This animal has been trapped. He must stay until another one of your animals comes to this Gambler's Stop to rescue him. When he draws a card, the animal which has been trapped earlier is free to go.

FIG. 4-7 2

Train derailed. Miss one turn

FIG. 4-8 1

Caught by Zoo Keeper. Is taken back to the cage

FIG. 4-9 1

Tarzan is here. He will take this animal to its home free.

FIG. 5-1

1

FIG. 5-2

2

FIG. 5-3

3

FIG. 5-4

4

FIG. 5-5

QUARANTINE

FIG. 5-6

AIR LIFT

BOARD GAME WITH ANIMAL TOKENS

BRIEF SUMMARY OF THE INVENTION

There are two parts combined in this invention. One part is the physical structure of the game, such as the map of the world on which invented air routes, ocean routes, air stations, ocean harbours, gambler's stops, railroad and marked native homes for animal tokens are planned. Also in the nature of physical structures are cards, die and animal tokens which represent different animals of the world. The physical structure parts of the game are to be made from the common practice of manufacturing. The map could be either printed on cardboard, a sheet of plastic or on a thick piece of paper. The other part of this invention is the method of playing the game which leads to manufacturing the physical part of the invention. The method of playing the game is conducted by first, each player drawing a plurality of cards on which the names of the animals of the world are printed along with the locations of their said native homes and some simple information about them. Then each player takes the said animal tokens which represent the animals on the said animal cards he has just drawn. He then sends his said animal tokens from one of the four corners of the said board marked as Cage 1, Cage 2, Cage 3, and Cage 4 to the said native homes of his animals which are represented by the said animal tokens. The object of the game is to be the first player to get all his said animal tokens in their said animal homes.

Between the starting points and the animals' homes, a player, by means of throwing die and drawing gambler's cards, meets various transportation opportunities—major cities of the world, harbours, air lifts. Thus, besides being entertained, a player, upon playing the game, will not only be familiarized with the native homes of the animals in the world but will also learn the geography of the world. Therefore, the educational value of this game is substantial. One of the unique qualities of the game is the using of a plurality of said animal tokens to place them in their actual native lands in the world. Another unique quality in this game is the chance factors of the die and gambling cards and the realism the chance factors symbolize. For example, when "Quarantine" shows on one side of the said die it means, according to the rules, that the said animal token belonging to the player who threw the die is to be held for quarantine purposes, therefore the player can not move his animal this turn. The players at certain points must draw cards on which penalties or bonuses are written. On these said cards, are a plurality of chance happenings which are substantially true to life, such as, animal being chased by zoo keeper, animal is trapped, animal is wounded by hunter, etc. An unusual feature of this game is that each player can choose four said animal tokens out of sixteen in each game, hence the rotating effects of knowing the animals as well as their native homes is acheived as consecutive games are played.

BRIEF DESCRIPTION OF THE DRAWING

FIG. 1-1 is the more detailed illustration of FIG. 1 on which only a portion of North America is shown.

FIGS. 2-1 to 2-16 are the animal tokens to be used in this game.

FIGS. 3-1 to 3-16 are the cards on which the names and pictures of the said animal tokens shown on FIGS. 2-1 to 2-16 are printed, along with the correct location of the sain animal's home and some simple information about the animals. A number which corresponds to the number marked on the said animal's home on the said world map is printed to tell the location of its animal home.

FIGS. 4-1 to 4-9 show the face of nine different gambling cards which a player draws when his animals land on a gambler's stop on on the game board. The numbers on the top right side of the figure indicate the quantity of each kind of said gambling card.

FIGS. 5-1 to 5-6 show the six sides of the die.

DETAILED DESCRIPTION

This game is contructed on a board or plastic or a thick piece of paper on which the map of the world with routes, stops, and animals' native homes are marked. Each continent, route, stop, and animal's home is colored for easier distinction for the players. Two to four persons can play this game. Each player gets four said animal tokens by drawing the said animal token cards which indicate what animal tokens he should get. Then each player, in turn, moves his animal tokens step by step as indicated on the said die he throws according to rules, or, he may move the animal tokens through faster via air lines, ocean express, and sled routes toward the said native homes of his said animals (tokens). One by one a player sets his said animals (tokens) on the said marked and numbered home bases of his animal tokens until all four of his said animal tokens are in the said animal homes. Whoever gets all his said animal tokens home first wins. In this game, however, players may get as few as two animal tokens or as many as eight, depending on the number of players participating in the game and the time the players wish to spend per game.

Figure 1:
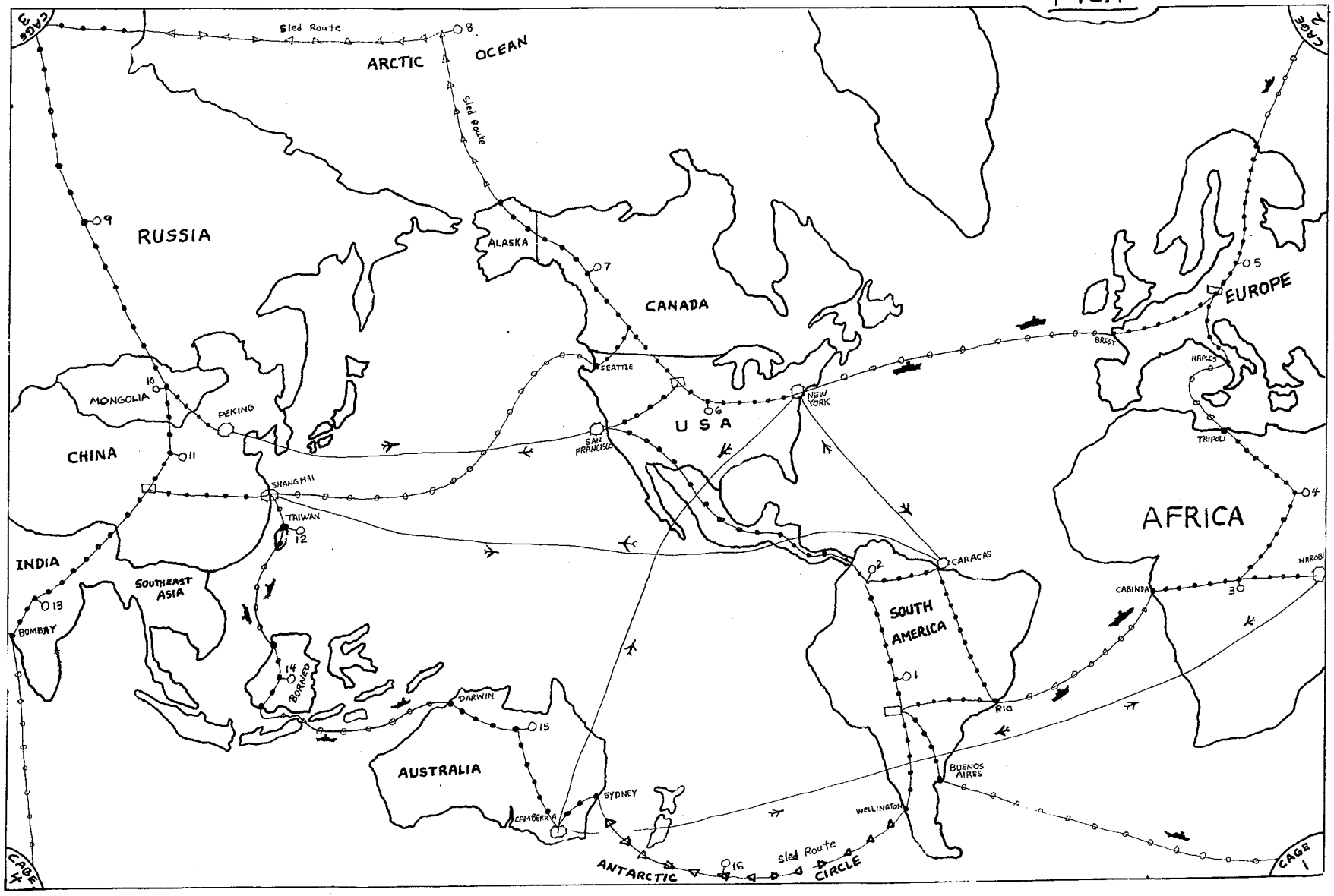
FIG. 1 shows the whole board of the game.
Figure 1:
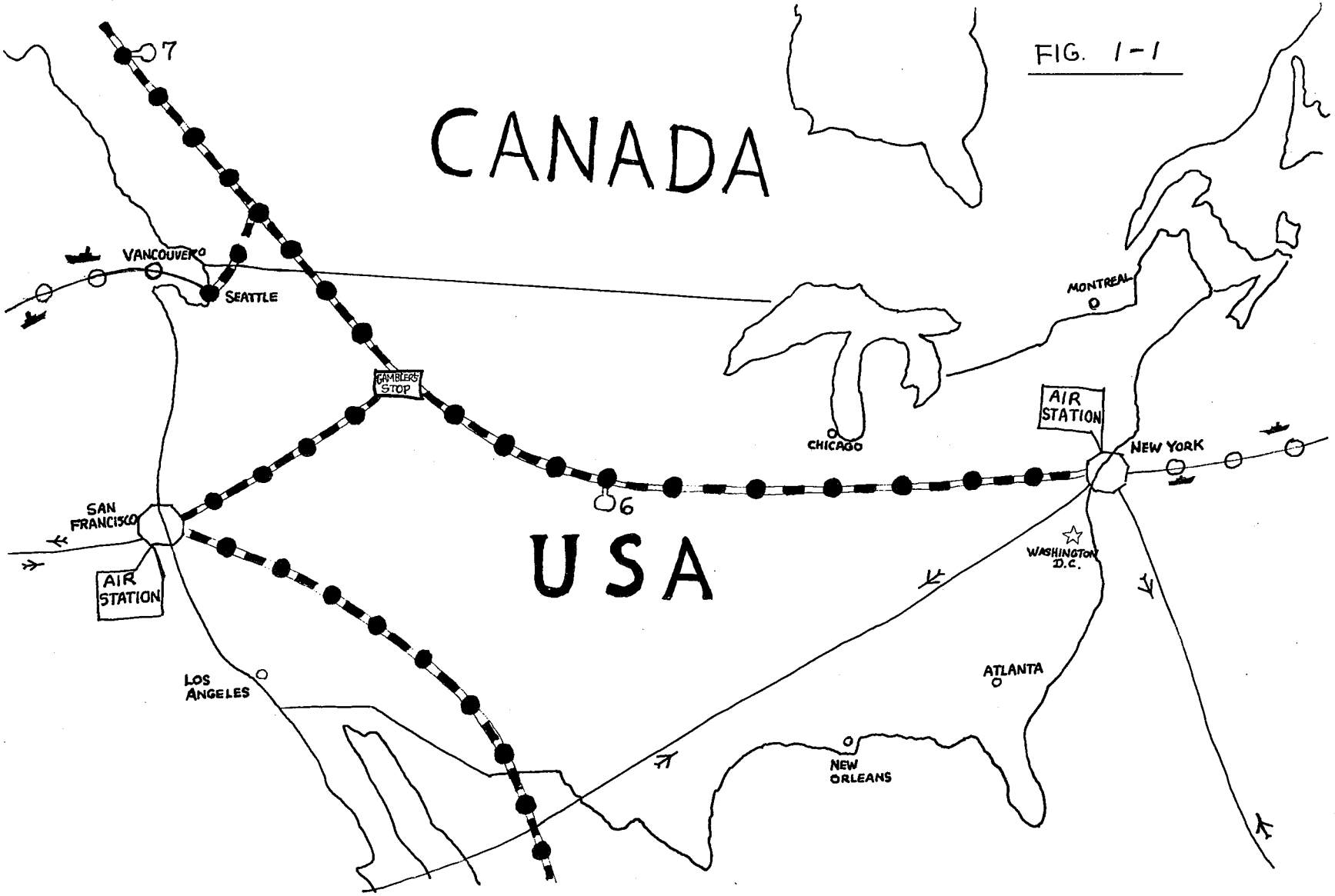

FIG. 1 shows the whole said playing board on which the said world map is marked, featuring said game routes, stops, and animal homes. Besides the air stations and harbour cities, which are marked as the necessity of the game, some major cities of the world are also printed for the knowledge of the players. On the said game map, the size of the ocean has been reduced in relation to the land portion. This is done for the convenience of playing the game. On the four corners of the said map are the cages marked Cage 1, Cage 2, Cage 3, and Cage 4 which are the starting points for the players. There are five air routes connecting major cities of the world such as Peking—San Francisco, New York—Canberra, New York—Caracas, Canberra—Nairobi, Shanghai—Caracas. There are many ocean routes connecting major harbour cities of the world on which dots are evenly spaced indicating steps which are used when a player tries to cross the ocean without getting an ocean express die. Hence, the steps on an ocean route are treated just the same as those on the land portion of the said world map. If a player throws the die and an ocean express shows, he may slide from the harbour on which his animal token stands to the end of the ocean route in one step.

FIG. 1-1: Is the detailed enlargement of FIG. 1. Shown here is only the North America portion of the said board map. Seattle is a harbour city with ocean route to Shanghai. San Francisco is an air station connected to Peking as well as a rail station with two tracks, one going northeast to a gambler's stop, one going southwest towards South America. In the upper left corner of FIG. 1-1 of the board, in Canada, is the animal's home for the Bighorn which is marked as "7". In North Central America is an animal's home for the Bison which is marked "6". In the eastern part of the United States is New York which is both a harbour with an ocean route connecting it to Europe and an air station with a flight to Caracas.

FIGS. 2-1 to 2-16: Animal tokens; they may be made of plastic, rubber, or any other solid, harmless material. Each token is about ¾ inch in size.

FIGS. 3-1 to 3-16: Are sixteen animal cards printed with pictures of the said animals, their names, their native homes and simple information about them. There are numbers on the cards which correspond to numbers on the game map to tell the exact location of the said animals' homes for each and every animal. Each of the sixteen cards represents one animal.

Figures 1, 2:
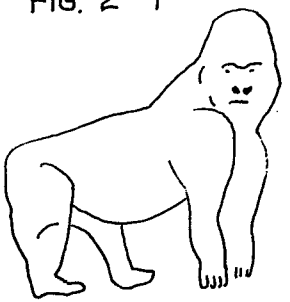
Figure 2:
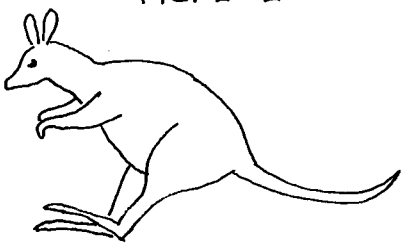
Figures 2, 3:
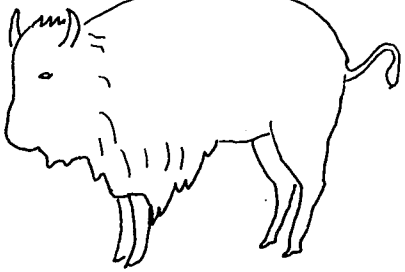
Figures 2, 3, 4:
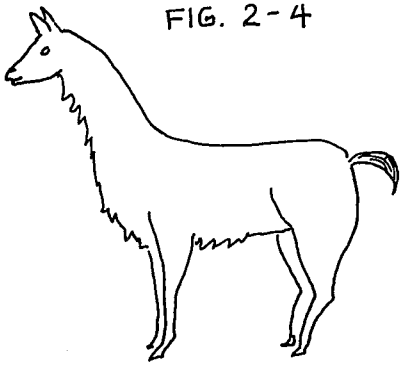
Figures 2, 3, 4, 5:
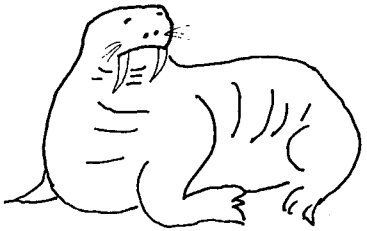

FIGS. 4-1 to 4-9: Show the gambling cards. These are the cards to be drawn by a player on his option when he lands his animal token on the gambling stop on the game board. If the player does not wish to gamble (draw cards) he may stand still. As the instructions which are printed on the cards indicate, there are nine different kinds of gambler's cards. Each kind tells exactly what the player should do. It may be favorable or unfavorable for the player. The numbers on top of these gambler's cards are the number of copies of each kind of the said gambler's cards. They are all in same size, have the same back cover pattern design. They should be made of paper or plastic. FIGS. 4-1 to 4-5 have three copies each. FIGS. 4-6 and 4-7 have two copies each. FIGS. 4-8 and 4-9 have only one copy each. Totally there are twenty-one cards.

Figures 2, 3, 4, 5, 6:
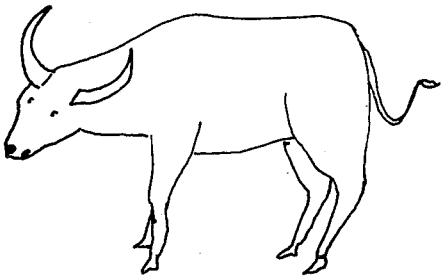
Figures 2, 3, 4, 5, 6, 7:
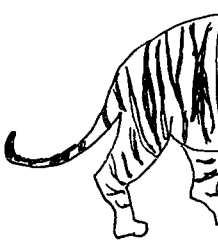
Figures 2, 3, 4, 5, 6, 7, 8:
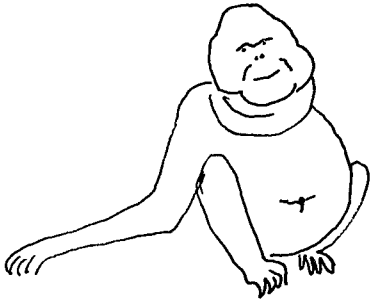
Figures 2, 3, 4, 5, 6, 7, 8, 9:
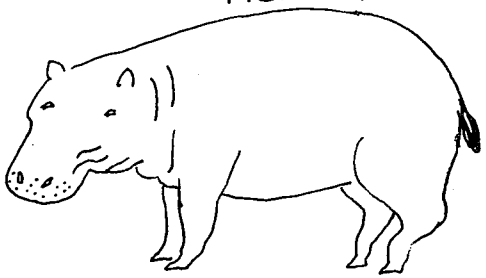
Figures 2, 3, 4, 5, 6, 7, 8, 9, 10, 11, 12:
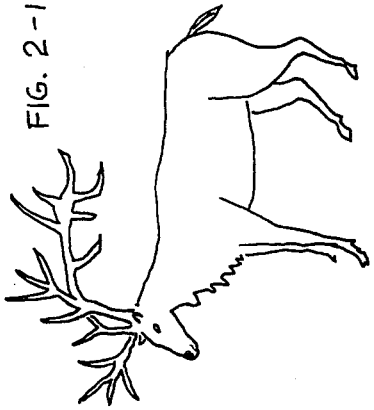
Figures 2, 3, 4, 5, 6, 7, 8, 9, 10, 11:
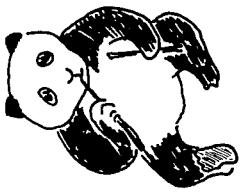
Figures 2, 3, 4, 5, 6, 7, 8, 9, 10:
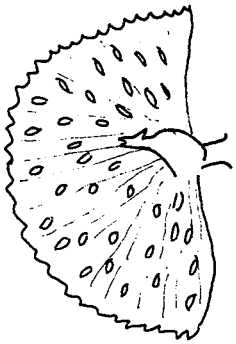
Figures 2, 3, 4, 5, 6, 7, 8, 9, 10, 11, 12, 13, 14, 15:
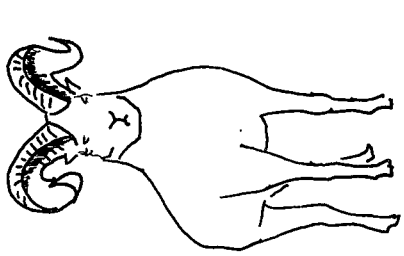
Figures 2, 3, 4, 5, 6, 7, 8, 9, 10, 11, 12, 13, 14:
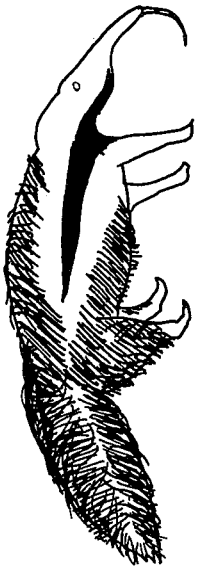
Figures 2, 3, 4, 5, 6, 7, 8, 9, 10, 11, 12, 13:
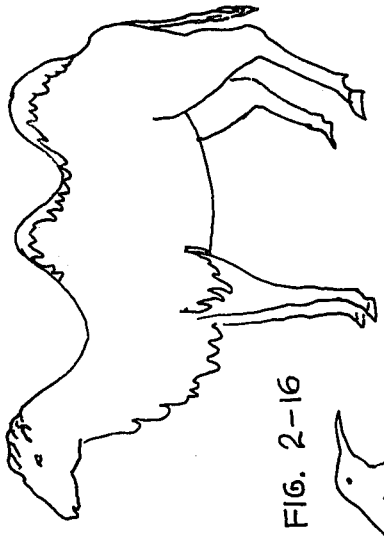
Figures 2, 3, 4, 5, 6, 7, 8, 9, 10, 11, 12, 13, 14, 15, 16:
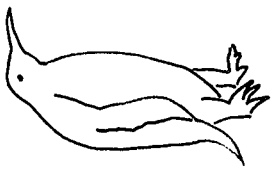
Figures 1, 3:
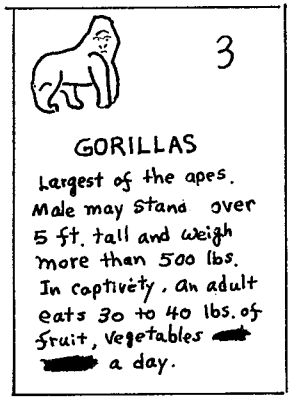
Figures 2, 3:
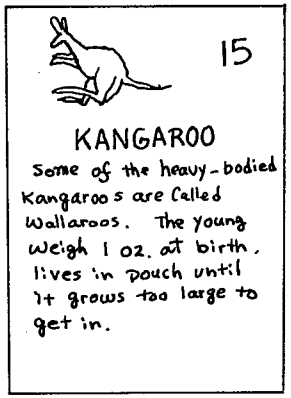
Figure 3:
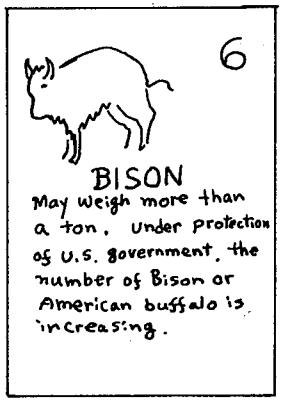
Figures 3, 4:
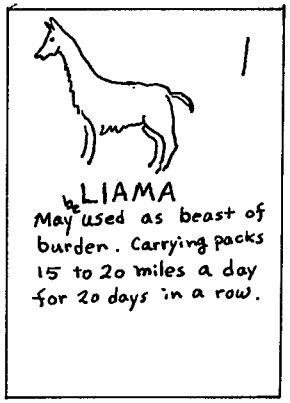
Figures 3, 4, 5:
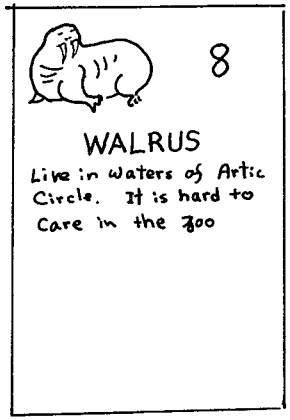
Figures 3, 4, 5, 6:
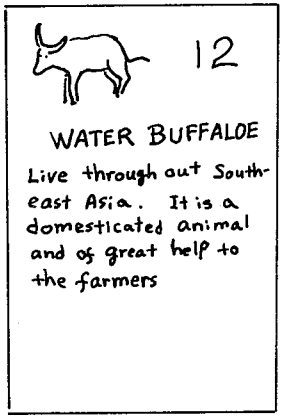
Figures 3, 4, 5, 6, 7:
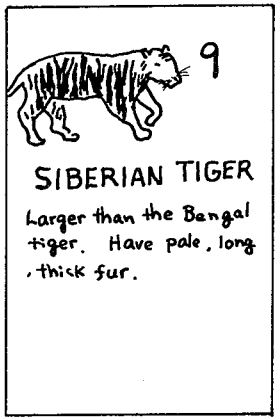
Figures 3, 4, 5, 6, 7, 8:
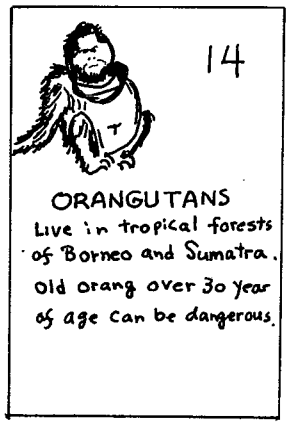

FIGS. 5-1 to 5-6 are each side of the six-sided die. After throwing the die, the player does whatever the face up side of the die indicates per instructions in the rules of the game.

GAME RULES

1. Two to four people can play this game at one time.
2. Each player selects an animals' cage marked as Cage 1, 2, 3, and 4.
3. Each player alternately draws four cards labeled "Animal Card". However, each player may draw as few as two cards or as many as eight cards depending on the number of players and the time the players wish to spend per game as long as all the players draw the same number of these "Animal Cards".
4. Each player takes the four token animals represented by the cards he holds and puts the animal tokens in his corner marked "CAGE 1, 2, 3, or 4".
5. The first player throws the die and moves the animal of his choice exactly as many steps as are indicated by the throw of the die. He then passes the die to the next player.
6. A player can move his animal token either forwards or backwards the number of steps indicated on the die.
7. If a player throws the die and "Quarantine" appears, he misses his turn.
8. If a player is on an air station when he throws the die, and "Air Lift" appears, he may fly to the air station at the end of his flight line in that one move. If he is not on an air station, he cannot move.
9. If a player lands at a harbour, he may get a free ocean express ride to the harbour at the end of the boat ride, i.e., he can slide to that harbour.
10. A player may have one or all of his animals on the board at one time.
11. At certain crossroads on the track are stops marked "GAMBLER'S STOP". If a player lands an animal token on one of these stops, he must draw a card marked "GAMBLER'S CARD" and do as it instructs. However, if he does not wish to gamble, he may just move another one of his animals, or he may just stand still until his next turn if he chooses.
12 Two players' animals going the opposite direction may pass one another, but no player's animal may pass another animal going in the same direction.
13. A player must take the number of steps indicated by the die or miss his turn.
14. Air stations, harbours, and "Gambler's Stops" may be occupied by more than one animal at the same time, provided the animals do not belong to the same player. No other spaces may be occupied by more than one animal at one time.
15. An animal trapped at the "Gambler's Stop" because he drew an unlucky card will be automatically freed by the landing of another animal at the "Gambler's Stop". The freed animal may move out on a future throw of the die. If the rescuing animal is also trapped when he draws a card upon entering the "GAMBLER'S STOP", the freed animal may rescue him after leaving and reentering the "GAMBLER'S STOP".

In this invention I claim:

1. A board game consisting of a playing surface on which are printed indicia of the following;

an approximate map of the world wherein the land masses are of exaggerated size in relationship to the oceans but in which the relative proportions of the land masses are approximately preserved, a plurality of locations on said land masses and in the oceans which represent the actual native homes of certain animals, the locations of actual cities, areas at certain intersections of transportation routes designated as gamblers stops and locations in the corners of the playing surface designated as cages.

a pluality of transportation routes representing both actual and fictitious routes of land, air and sea transportation which interconnect in part the locations of the animal homes, actual cities, and said areas at certain intersections of transportation routes designated as gamblers stops and locations in the corners of the playing surface designated as cages, and where said transportation routes are divided into a plurality of incremental distances by further printed indicia;

together with a plurality of animal tokens corresponding in their number to the number of animal homes and in their appearance to the animal which they represent, a set of Animal Cards being of uniform ornamental pattern on the secondary surface and each having on its primary surface printed indicia including the name and likeness of a particular animal, that animal's native home, some simple information concerning the animal, and a numerical designator which corresponds to a numerical designator on the playing surface at said animals native home, a set of Gamblers Cards being of uniform ornamental pattern of the secondary surface and each having on its primary surface printed indicia designating particular conditions of penalty or bonus to which the players move is subject.

2. A game according to claim 12 wherein players have the objective of moving said animal tokens from his assigned Cage to the actual animal native homes as indicated on the corresponding Animal Card and which has a corresponding numerical designation.

3. A game according to claim 1 wherein the animal tokens include all or some of; gorilla, kangaroo, bison, llama, walrus, water buffalo, Siberian tiger, orangutan, hippopotamus, peacock, giant panda, reindeer, Bactrian camel, giant anteater, big horn sheep and emperor penguin.

* * * * *